United States Patent [19]

Takinami et al.

[11] 4,414,828

[45] Nov. 15, 1983

[54] LOCKING APPARATUS FOR COMPARTMENT DOOR OPERATED BY A KEY

[75] Inventors: Toshikazu Takinami; Masao Horaguchi, both of Toyota; Keizo Suzuki, Inazawa, all of Japan

[73] Assignee: Toyota Jidosha Kogyo Kabushiki Kaisha Tokai-Rika-Denki-Seisakusho, Toyota, Japan

[21] Appl. No.: 272,279

[22] Filed: Jun. 10, 1981

[30] Foreign Application Priority Data

Jun. 18, 1980 [JP] Japan ..... 55-85442[U]

[51] Int. Cl.[3] ..... E05B 63/12; E05B 65/06; E05C 3/10; E05C 3/26

[52] U.S. Cl. ..... 70/84; 70/142; 70/207; 70/379 R; 70/DIG. 42; 292/216; 292/229

[58] Field of Search ..... 70/84, 141, 142, 207, 70/379–380, 80, 78, 162, DIG. 42, 216, 215, 210; 292/229, 216

[56] References Cited

U.S. PATENT DOCUMENTS

| | | | |
|---|---|---|---|
| 387,523 | 8/1888 | Loch | 70/DIG. 42 |
| 1,674,513 | 6/1928 | Jacobi | 70/380 X |
| 1,747,383 | 2/1930 | Norviel | 70/216 |
| 2,182,307 | 12/1939 | Behnke | 70/DIG. 42 |
| 2,194,244 | 3/1940 | Machinist | 70/379 R X |
| 2,221,095 | 11/1940 | Jacobi | 70/84 |
| 2,313,711 | 3/1943 | Jacobi | 70/84 X |
| 2,976,714 | 3/1961 | Hofgesang | 70/DIG. 42 |
| 3,003,348 | 10/1961 | Jacobi | 70/84 |
| 3,429,153 | 2/1969 | Magyar | 70/142 X |
| 3,581,532 | 6/1971 | Andersen et al. | 70/84 |
| 3,691,799 | 9/1972 | Hoffmann et al. | 70/84 |
| 4,300,374 | 11/1981 | Mullich et al. | 70/379 R X |

FOREIGN PATENT DOCUMENTS

| | | | |
|---|---|---|---|
| 642236 | 8/1950 | United Kingdom | 70/216 |

*Primary Examiner*—Robert L. Wolfe
*Assistant Examiner*—Carl F. Pietruszka
*Attorney, Agent, or Firm*—Parkhurst & Oliff

[57] ABSTRACT

A locking apparatus for a compartment door operated by a key comprises an outer cylinder fixed in the compartment door, a rotor inserted into the cylinder, a plurality of locking plates inserted into the rotor radially slidably to engage with the cylinder, one or more engaging plates insesrted into the rotor radially slidably, a ring surrounding the rotor independently rotatable with respect to the rotor,a lip projected from the ring engageable with the engaging plates, operating means to rotate the ring, and engaging means maintains the door closed and releasable by the rotor. In door-opening operation, the rotor is rotated by the key from a locking position to an releasing position, then the key is removed to engage the ring with rotor. This engagement enable the operating means to rotate the rotor through the ring.

9 Claims, 7 Drawing Figures

LOCKING APPARATUS FOR COMPARTMENT DOOR OPERATED BY A KEY

BACKGROUND OF THE INVENTION

The present invention relates to a locking apparatus for a compartment door of a motor vehicle which is operated by a key.

As shown in FIG. 1, a locking apparatus a of the sort in the prior art includes a rotor b rotated by a key (not shown) between a locking position and a releasing position (the position shown in FIG. 1). Provided on the front face of the rotor is a pair of pins, which are engageable with pistons d respectively at the releasing position. This engagement enables the pistons to rotate the rotor anticlockwise until it reaches to a door-opening position where the rotor releases the door to open. While in order to rotate the rotor clockwise until it reaches to the locking position where the rotor locks the door, the pistons should be disposed in such a manner that the pistons do not interfere with the pins. If the pistons interfere with the pins, it is impossible to rotate the rotor to the locking position. Accordingly the distance L between the pin and the piston at the releasing position is fairly long, so the stroke of the pistons is considerably long. The long stroke of pistons enlarges the apparatus and increases its production cost.

SUMMARY OF THE INVENTION

Accordingly, it is an object of the present invention to provide a locking apparatus for a compartment door, in which the operating stroke is minimized.

It is another object of the present invention to provide a locking apparatus of simple construction.

It is another object of the present invention to provide a locking apparatus which can lock the compartment door in a reliable manner.

It is another object of the present invention to provide a locking apparatus which is convenient to lock and release the compartment door.

It is further another object of the present invention to provide a locking apparatus which can push the compartment door open automatically when it is released.

According to the present invention, a locking apparatus for a compartment door operated by a key comprises an outer cylinder fixed in the compartment door, a rotor inserted into the cylinder, a plurality of locking plates inserted into the rotor radially slidably to engage with the cylinder, one or more engaging plates inserted into the rotor radially slidably, a ring surrounding the rotor independently rotatable with respect to the rotor, a lip projected from the ring engageable with the engaging plates, operating means to rotate the ring, the engaging means maintains the door closed and releasable by the rotor. In door-opening operation, the rotor is rotated by the key from a locking position to a releasing position, then the key is removed to engage the ring with rotor. This engagement enables the operating means to rotate the rotor through the ring.

DETAILED DESCRIPTION OF THE INVENTION

Figure 1:
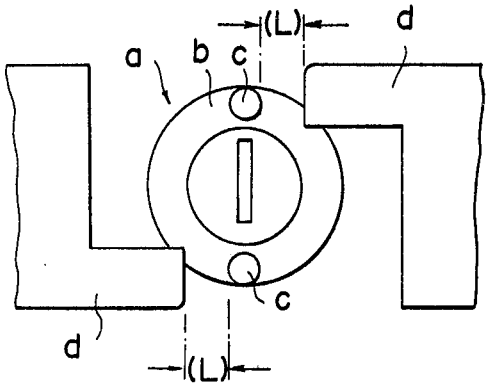
FIG. 1 shows a front elevational view of the prior art.
Figure 6:
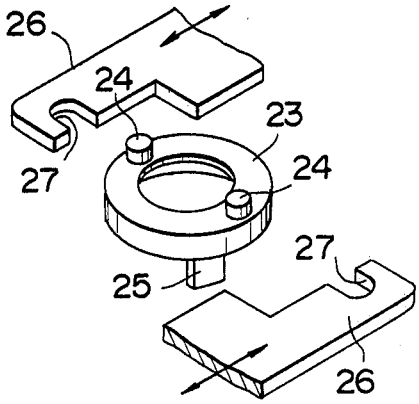
FIG. 6 shows a perspective view of a ring and pistons in a disassembled condition.
Figure 4:
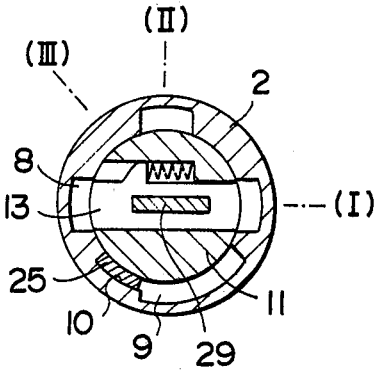
FIG. 4 shows a sectional view of a rotor of the embodiment which is at a locking position.
Figure 5:
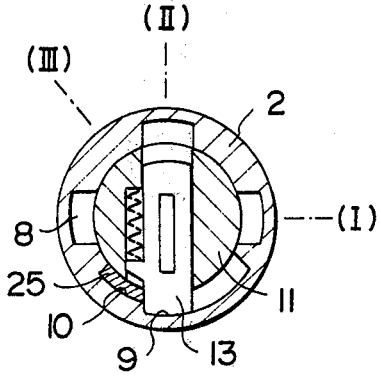
FIG. 5 shows a sectional view corresponding of FIG. 4, in which the rotor is at a releasing position.
Figure 2:
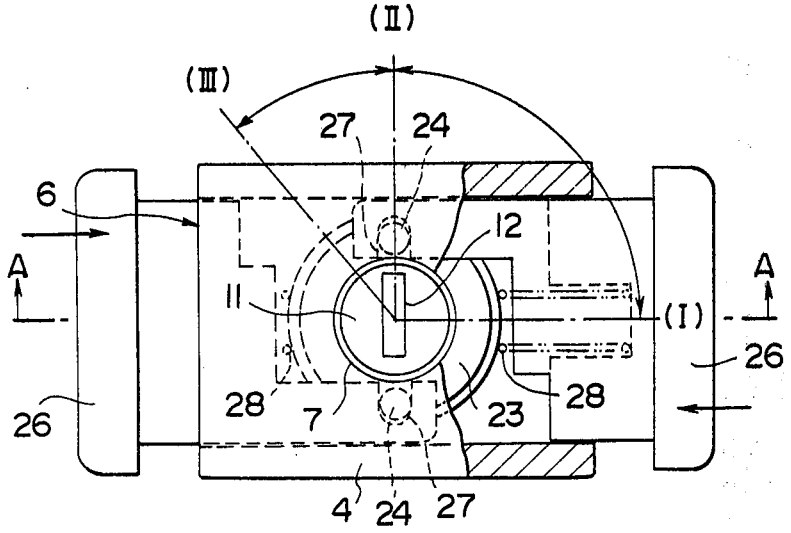
FIG. 2 shows a front elevational view of an embodiment of the present invention partially cut away.

In a embodiment of the invention as disclosed in the drawings, a locking apparatus for a compartment door includes a body 1 comprising an outer cylinder 2, a flange 3 surrounding the cylinder 2 and a casing 4 provided at an outer end of the body. The outer cylinder 2 is inserted into a hole 32 of the compartment door 31, and the flange 3 is secured to the periphery of the hole. The casing 4 is shaped like a pipe with a rectangular-cross-section, the axis thereof lies horizontally along outer surface of the door 31. A pair of pistons 26 are inserted into the casing 4 from the opening ends respectively. A rotor 11 is inserted into the cylinder 2, one end of which exposes toward the outside of the door 31 through an opening 7. A plurality of locking plates 13 are inserted into the rotor 11 radially slidably and are spaced apart from each other in the axial direction of the rotor. Each of the locking plates has a hole, while all of the holes define a hole 12 to receive the key 29. This hole 12 for receiving the key opens toward outside of the door 31 at the abovementioned end of the rotor 11 so as to be available for inserting the key 29 from the outside of the door. The rotor 11 rotates between a locking position (I) and a door-opening position (III), and the rotor 11 has further a releasing position (II) between the position (I) and (III). As shown in FIGS. 4 and 5, each locking plate 13 is biased radially by a coil spring to project radially from the rotor 11. Before the key 29 is inserted into the rotor at the locking position (I), the locking plates 13 project radially out of the rotor 11 to engage with recesses 8 of the outer cylinder 2. When inserted into the holes 12, the key 29 pulls the locking plates 13 into the rotor 11, so that the locking plates 13 are released from the recesses 8 to enable the rotor 11 to rotate. From the locking position (I) to the releasing position (II) the rotor 11 is rotated by the key, and from the releasing position (II) to the door-opening position (III) the rotor 11 is rotated not only by the key 29 but also by the pistons 26 as described hereinafter.

On the outer end portion of the rotor 11, a shoulder 22 is defined to receive a ring 23 surrounding the rotor 11. The ring 23 is rotatable independently with respect to the rotor 11. On the inner face of the ring 23 there is provided a lip 25 projecting inwardly of the cylinder 2. The lip 25 is received by a recess 10 of the outer cylinder 2. In the adjacent circumferential position to the recess 10, the cylinder 2 has a recess 9 communicating with the recess 10. The ring 23 is rotatable in a range that the lip 25 passes through the recess 9 and 10. On the outer face of the ring 23, a pair of pins 24 are projected outwardly of the cylinder 2. Each of the pins 24 engages with a recess 27 of the piston 26, so that the ring is cooperatively rotatable with the pistons 26. The pistons 26 are positioned symmetrically each other, and reciprocable toward and apart from each other. In the casing 4 there is provided a pair of coil springs 28 between the cylinder 2 and each of the pistons 26. The springs 28 biases the pistons 26 in the direction that the pistons 26 depart from each other. When the pistons 26 are pushed by the springs 28 to the outer end position, the ring 23 is at such an angular position that the lip 25 lies in the recess 10.

When the key 29 is removed at the releasing position (II), the locking plates 13 project again radially out of the rotor 11 into the recess 9. The locking plate 13 placed nearest to the outer end of the rotor 11 is also engageable with the lip 25, when the plate 13 is inserted into the recess 9. Accordingly the pistons 26 can rotate the rotor 11 through the ring 23, the lip 25 and the plate 13 toward the door-opening position (III).

Figure 7:
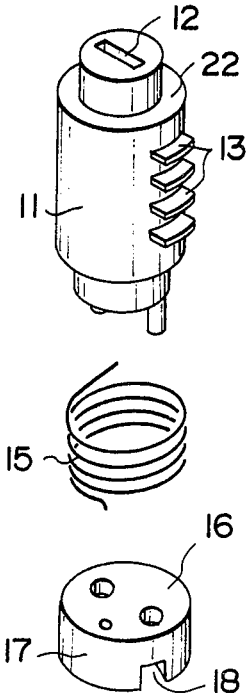
FIG. 7 shows a perspective view of the rotor, a torsion spring and a cam in a disassembled condition.

In FIG. 7, on the inner surface of the rotor, a pair of driving pins 14 project inwardly of the cylinder 2. The inner portion of the cylinder 2 holds an annular cam 16 rotatably. The driving pins 14 engage with the cam 16 so that the cam 16 is driven to rotate by the rotor 11. A torsion spring 15 lies around an inner end portion of the rotor 11, while one end of this spring is fixed on the cylinder 2 and the other end of the spring is fixed on the cam 16. The spring 15 biases the rotor 11 through the cam 16 to restore the rotor 11 back to the locking position (I). Namely the rotor 11 is automatically restored to the locking position (I) when the key 29 is kept inserted into the hole 12.

At the inner end of the body 1 there is provided a support 5 to support pivotally a locking ratchet 19. The ratchet 19 pivots inwardly or outwardly of the door 31. The support 5 further holds a torsion spring to bias the ratchet 19 anticlockwise in FIG. 3 inwardly of the door 31.

A passageway-channel 18 is defined by side walls 17 at the inner end portion of the cam 16. When the channel 18 alignes with ratchet 19, the ratchet 19 turns anticlockwise, whereby a portion 20 thereof passes through the channel 18. When the channel 18 does not align with the ratchet 19, the portion 20 can be held by one of the wall 17 to stop the ratchet 19. The body 1 includes further a stopper which abuts the ratchet 19 to limit the anticlockwise pivotal movement of the ratchet 19. The cam 16 cooperates with the rotor 11, so that the channel 18 does not align with the ratchet when the rotor 11 is in the locking position (I), and that the channel 18 alignes with the ratchet 19 when the rotor 11 is in the door-opening position (III).

The ratchet 19 has a fork 21 engageable with a fixed pin 33 which is fixed on the ceiling of compartment box inside of the door 31.

OPERATION

In the locking condition, the fork 21 engages with the pin 33 to keep the door 31 close. At this time the walls 17 holds the portion 20 and the rotor 11 is in the locking position (I).

By inserting the key 29 into the hole 12 the rotor 11 becomes free to rotate in the cylinder 2.

By rotating the rotor 11 by means of the key 29 from the locking position (I) to the releasing position (II), it is possible to rotate the rotor 11 not only by the key kept inserted into the hole 12, but also by the pistons 26 when the key 29 is removed from the hole 12. When the key 29 is removed at the releasing position (II) of the rotor 11, the engageable one of the locking plates 13 engages the lip 25 to make the rotor 11 cooperate with the pistons 26. This cooperation enables the pistons 26 to rotate the rotor 11 without such an idle movement that the pistons d of the apparatus in the prior art move through a distance of L.

Figure 3:
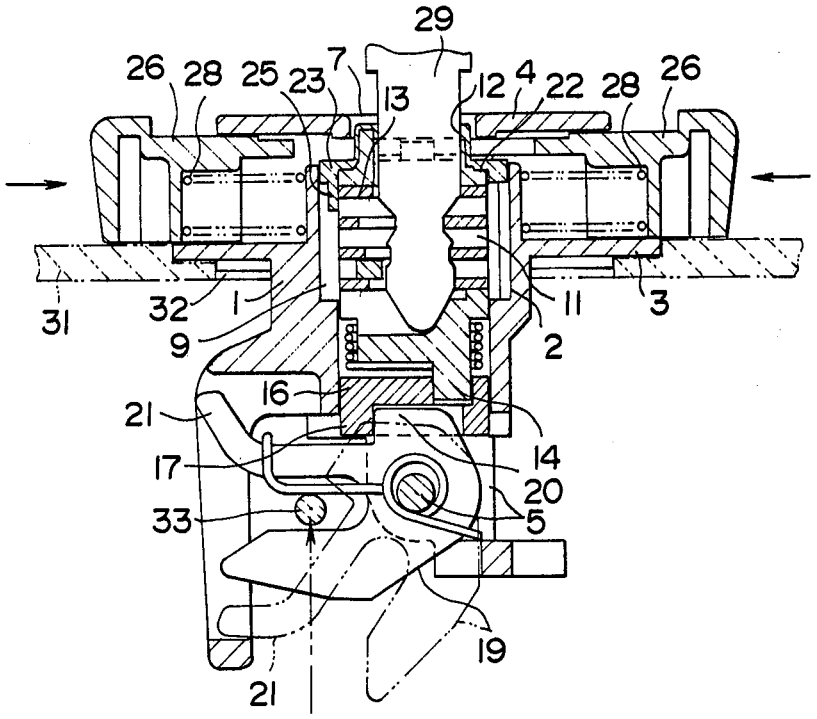
FIG. 3 shows a sectional view along line A—A of FIG. 2.

By rotating the rotor 11 by the key 29 or by the pistons to the door-opening position (III), the cam 16 rotates to an angular position so that the channel 18 allows the portion 20 to pass therethrough. Then the ratchet 19 turns anticlockwise in FIG. 3 abutting against the pin 33 to push the door 31 open. The door 31 is pivoted on the righthand portion (not shown) in FIG. 3, so during the opening movement of the door 31, the fork 21 of the ratchet 19 retreats from the pin 33 to be free from the pin (as shown in FIG. 3 by a two dot chain line).

In this condition a part of the bolt, namely portion 20 is inserted into the channel 18 to prevent the cam from rotating toward the locking position (I). Accordingly the door is opened automatically only by rotating the rotor 11 to the door-opening position (III).

When the door 31 is moved from the opened condition to the closed condition, the fork 21 of the ratchet 19 moves toward the pin 33 holded by the stopper of the body 1 so as to engage with the pin 33. After this engagement of the ratchet 19 with the pin 33, the pin 33 guides the ratchet 19 to turn the ratchet 19 clockwise until the position of the solid line in FIG. 3. In this position the cam 16 and the rotor 11 becomes free from the ratchet 19 to rotate toward the locking position (I). Namely the door 31 is locked automatically only by pushing the door 31 close.

Although the invention has been described in its preferred embodiment with a certain degree of particularity, it may be appreciated that many apparently widely different embodiment can be made without departing from the spirit and scope of the invention.

For example one or more engaging plates are applicable which do not contribute to engaging the rotor with the outer cylinder, instead of the one of the locking plate engaging with the lip. The springs such as the spring 15 may be changed to other types of bias means. The fixed pin 33 can be fixed on the side wall or on the floor of the compartment box.

What is claimed is:

1. A locking apparatus for a compartment door operated by a key comprising:

an outer cylinder fixed in the compartment door;

a rotor inserted into said cylinder so as to freely rotate between a locking position and a door opening position substantially coaxially with said cylinder, one end of said rotor being exposed toward the outside of the compartment door, and said rotor being provided with a hole opening at said one end thereof so as to be available for inserting the key from the outside of the door;

a plurality of locking plates which are inserted into said rotor radially slidably and are spaced apart from each other in the axial direction of said rotor;

one or more engaging plates which are inserted into said rotor radially slidably;

a ring surrounding said rotor and independently rotatable with respect to said rotor;

a lip projected from said ring in the axial direction of said rotor and engageable with said engaging plate;

operating means for rotating said ring; and engaging means which maintains the compartment door closed and is released by said rotor at the door-opening position;

whereby said locking plates project radially out of said rotor to engage said outer cylinder at the locking position of said rotor before the key is inserted into said hole, the key pulls said locking plates into said rotor to release said locking plates from said cylinder when the key is inserted into the hole, said rotor is rotated from the locking position to a releasing position between the locking position and the door-opening position, at this releasing position said engaging plates project radially out of the rotor to engage with said lip when the key is pulled out of the hole so that the rotor is operable by said operating means.

2. A locking apparatus as claimed in claim 1, wherein said engaging plates comprises one or more of said locking plates.

3. A locking apparatus as claimed in claim 1, further comprising first bias means for biasing said locking plates outwardly of said rotor.

4. A locking apparatus as claimed in claim 3, further comprising second bias means for restoring said rotor back to said locking position.

5. A locking apparatus as claimed in claim 1, wherein said operating means comprises a pair of symmetrical pistons which are slidable along the outer surface of the compartment door.

6. A locking apparatus as claimed in claim 5, further comprising third bias means for biasing said pistons in the direction that pistons depart from each other.

7. A locking apparatus as claimed in claim 6, wherein said ring rotates in the direction opposite to the direction toward the locking position when said pistons approach to each other and the key is removed so that said rotor rotates toward the door-opening position.

8. A locking apparatus as claimed is claim 1, wherein said engaging means comprising a hook which engages with a pin fixed inside of the compartment door.

9. A locking apparatus as claimed in claim 8, further comprising fourth bias means which biases said hook against the pin so that said hook pushes the compartment door open when the rotor is at the door opening position.

* * * * *